United States Patent [19]

Coble

[11] Patent Number: 4,936,758

[45] Date of Patent: Jun. 26, 1990

[54] DIAPHRAGM PUMP

[75] Inventor: Stephen J. Coble, Sun Valley, Calif.

[73] Assignee: ACI Medical, Inc., Sun Valley, Calif.

[21] Appl. No.: 231,967

[22] Filed: Aug. 15, 1988

Related U.S. Application Data

[63] Continuation-in-part of Ser. No. 83,069, Aug. 10, 1987, abandoned.

[51] Int. Cl.[5] ..... F04B 43/04

[52] U.S. Cl. ..... 417/413; 92/103 SD

[58] Field of Search ..... 417/413; 92/103 SD, 92/99; 403/265, 266, 408.1

[56] References Cited

U.S. PATENT DOCUMENTS

| | | | |
|---|---|---|---|
| 3,026,909 | 3/1962 | Boteler | 92/103 SD |
| 3,356,404 | 12/1967 | Peters | 403/408.1 |
| 3,947,156 | 3/1976 | Becker | 417/413 X |
| 4,086,036 | 4/1978 | Hagen et al. | 417/413 |
| 4,293,971 | 10/1981 | Block | 15/98 |
| 4,305,702 | 12/1981 | Hartley | 417/413 |
| 4,518,317 | 5/1985 | Inoue | 417/413 X |
| 4,545,735 | 10/1985 | Ims | 417/413 X |
| 4,636,149 | 1/1987 | Brown | 417/413 X |
| 4,776,771 | 10/1988 | Kern | 417/413 X |

FOREIGN PATENT DOCUMENTS

| | | | |
|---|---|---|---|
| 2216937 | 10/1973 | Fed. Rep. of Germany | 417/413 |

OTHER PUBLICATIONS

I. Katz, Adhesive Materials and Their Properties and Usages, 6/1964, p. 51.

*Primary Examiner*—Leonard E. Smith
*Assistant Examiner*—Eugene L. Szczecina, Jr.
*Attorney, Agent, or Firm*—Roger A. Marrs

[57] ABSTRACT

A fluid pump is disclosed herein having a frame defining an internal pumping chamber in combination with a flexible diaphragm. A top ring retains the diaphragm in position on the frame and includes a central area carrying an actuation mechanism for cyclically maintaining the fluid pumping operation in the pumping chamber. Inlet and outlet valves are disposed in the frame and interconnected with the pumping chamber to complete the pump. The actuation mechanism includes a motor-driven eccentric cam coupled to the central diaphragm area with top surface attachment only.

2 Claims, 1 Drawing Sheet

FIG. 1.
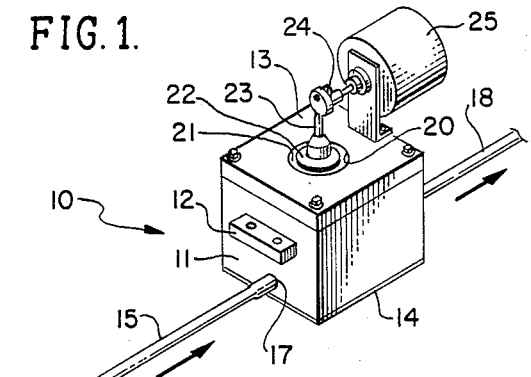
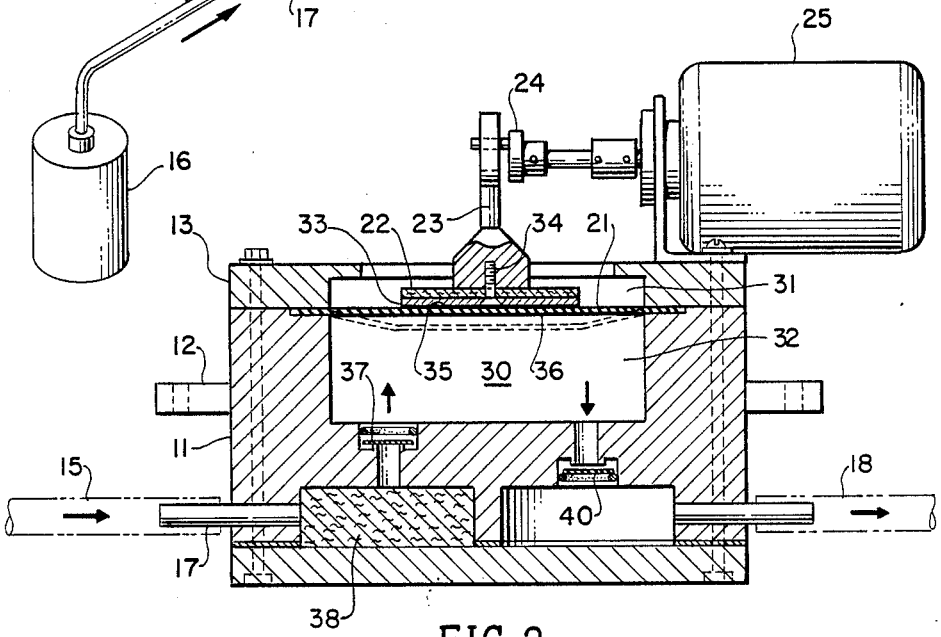
FIG. 2.
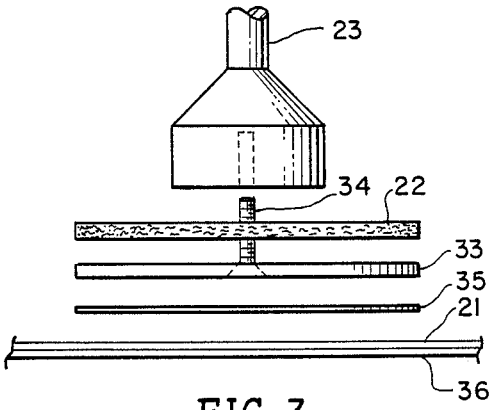
FIG. 3.
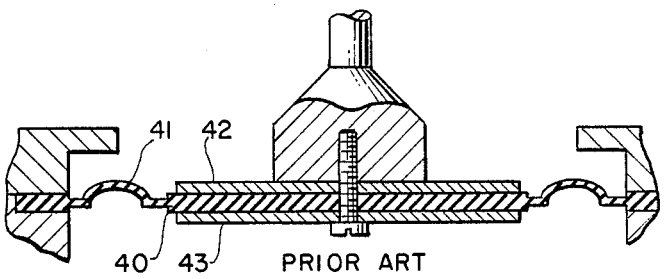
FIG. 4.
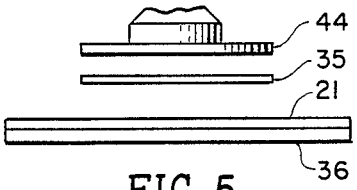
FIG. 5.

DIAPHRAGM PUMP

This is a continuation-in-part of application Ser. No. 07/083,069, filed on Aug. 10, 1987, now abandoned.

BACKGROUND OF THE INVENTION

1. Field of the Invention

This invention relates to the field of pumps and more particularly to a diaphragm pump free of leakage normally attendant with debris related pump leaks.

2. Brief Description of the Prior Art

There are many applications for fluid pumps where it is desirable for the pump not to leak fluid back through the pump's outlet port when the pump is stopped. For example, machines that automatically take a patient's blood pressure inflate a blood pressure cuff with air to some predetermined pressure below 6 PSI and then very slowly deflate the cuff at a precise rate. When the inflation pump halts at the desired pressure, it should ideally not allow air in the pressurized cuff to leak back through the pump since the precise deflation rate will not be achieved, thereby resulting in an erroneous blood pressure reading.

Leak-back primarily occurs through imperfections in the pump's one-way valves that do not allow the valves to operate as perfect check-valves. The problem is more frequently seen when there is a relatively small pressure gradient from inlet to outlet such as with the case of automatic blood pressure measurement machines. These imperfections are most often small pieces of debris that are shed from the pump's diaphragm.

The diaphragm employed in many pumps being used today have a hole in their center and the diaphragm is attached to a connecting rod with a washer on each side of the diaphragm's hole with a bolt projecting through the bottom washer, diaphragm hole, top washer and which screws into the bottom of the connecting rod. The bottom washer is therefore within the pumping chamber. As the diaphragm is moved in reciprocating motion, the diaphragm must stretch and/or move with respect to the bottom washer. Since the bottom washer is typically not flexible like the diaphragm is, some shearing action takes place between the diaphragm and bottom washer with each reciprocating motion of the diaphragm. The shearing action abrades the diaphragm and small particles of the diaphragm's material are shed to within the pumping chamber and can become deposited in the check valves.

When the pump is stopped, even a small piece of debris that happens to remain on a valve's sealing surfaces will cause a leak.

Therefore, a long standing need has existed which provides a diaphragm pump free from debris related problems resulting in pump leaks and clogging of check valves.

SUMMARY OF THE INVENTION

Accordingly, the above problems and difficulties are obviated by the present invention which provides a novel fluid pump having a frame or body in which a flexible diaphragm is employed for defining one side of a pumping chamber. The fluid intended to be pumped is introduced into the chamber via an inlet check valve and is intended to be exhausted through an exit or outlet port via an outlet check valve. The diaphragm is operably connected to a motor via an actuating means which comprises an eccentric cam connected to the diaphragm by an attachment arrangement comprising a washer adhesively attached to one side of the diaphragm and coupled to the terminating end of a connecting rod which is operated by the eccentric cam and motor. The diaphragm is reciprocally flexed by the actuating means and motor to draw fluid into the pumping chamber via the inlet valve and exhaust the fluid via the outlet port through the outlet check valve.

Therefore, it is among the primary objects of the present invention to provide a novel diaphragm pump having a flexible diaphragm movable by actuating means which is attached to one side of the diaphragm wherein the diaphragm is not subject to breakdown during actuation as in conventional diaphragm-operated valves or pumps.

Another object of the present invention is to provide a novel actuating means for operating a diaphragm in a diaphragm pump wherein the diaphragm comprises opposite planar surfaces which are flat wherein one surface contains powdered graphite coated over its entirety while the opposite planar surface is adhesively attached to the actuating means.

Another object of the present invention is to provide a novel diaphragm pump that is free from debris related problems normally resulting in pump leaks and clogging of check valves due to rapid deterioration of the diaphragm itself during the pumping procedure.

Another object of the present invention is to provide a novel diaphragm pump which includes a mounting occupying less space, primarily in height measurement, and which is less costly to manufacture than conventional pump bodies or frames.

Still a further object of the present invention is to provide a novel diaphragm pump which is relatively inexpensive to manufacture and which creates less noise during operation.

Still a further object of the present invention is to provide a novel diaphragm pump wherein the diaphragm is mounted across one side of the pumping chamber in such a way as to avoid shear forces normally encountered as the diaphragm is stretched due to reciprocating motion of the actuating means whereby debris is avoided that would normally disrupt check valve seating action and operation.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a perspective view showing the novel diaphragm pump in a typical installation;

FIG. 2 is an enlarged longitudinal cross-sectional view of the novel diaphragm pump shown in FIG. 1;

FIG. 3 is an enlarged fragmentary view, shown in section, of the diaphragm used in the pump shown in FIGS. 1 and 2;

FIG. 4 is a view similar to the view of FIG. 3 illustrating a conventional diaphragm mounting experiencing the problems and difficulties mentioned above; and FIG. 5 illustrates an integral construction of the washer with the connecting rod.

DESCRIPTION OF THE PREFERRED EMBODIMENT

Referring to FIG. 1, the novel diaphragm pump of the present invention is shown in the general direction of arrow 10 which includes a body 11 having integral mounting brackets 12 outwardly extending from each side of the body 11 and having a top plate 13 and a bottom plate 14. The mounting brackets are integral to the pump body and maintain a low profile for the body as well as reducing the cost in manufacture. Also, less noise is generated by the pump since it is more rigidly mounted with a higher resonant frequency. If preferred, the mounting bracket can also be integral with the pump top ring with similar advantages.

The pump further includes an input line 15 connected at one end to a reservoir 16 and at its opposite end to an inlet 17 leading into the interior of the body 11. An outlet conduit or tube 18 exits exhaust fluid from the body 11 after supply by the reservoir and input tube 15. The top plate 13 is provided with an opening 20 exposing a portion of a flexible diaphragm 21 as well as a coupling washer 22 connected to an actuating mechanism comprising a link 23 coupled to an eccentric cam 24 which is operated by a motor 25.

The pump of the present invention is illustrated in FIG. 2 wherein the diaphragm is of a straight or liner configuration not having convolutions molded therein and wherein the diaphragm is extended across an internal cavity identified by numeral 30. The edge marginal regions of the diaphragm are captured between the top plate 13 and the body 11 so that a major area of the diaphragm is exposed across the cavity 30 separating the cavity into a pair of chambers 31 and 32. The motor 25 is connected to a connecting rod 23 via an eccentric cam 24 that revolves and urges the connecting rod to move in an up and down movement in a regular cyclic manner. The opposite end of the connecting rod from its end coupled to the eccentric cam is attached to the diaphragm via a fabric washer 22, a metallic bottom washer 33 having a central opening which is countersunk in order to receive the shank of a screw 34. The screw 34 attaches both washers 22 and 33 to the end of the connecting rod 23. The washer 33 and screwhead are attached to the central region of the diaphragm 21 by means of an adhesive broadly identified by numeral 35. For manufacturing convenience, the fabric washer 22, the metal washer 33 and connecting rod 23 may be integrally molded as one piece, thus eliminating the need for the screw 34. Also, the underside of the diaphragm residing within the chamber 32 is coated with a fine powdered graphite material 36.

The fluid to be pumped from reservoir 16 enters the pump through the inlet port 17 via conduit 15 and passes through an inlet check valve 37 when the diaphragm is pulled upwardly by the action of the motor and eccentric cam via the connecting rod 23. A filter 38 is disposed within the inlet port so as to condition the fluid prior to passage through the inlet check valve 37. When the diaphragm moves downward by the action of the motor and eccentric cam, the pump fluid within the chamber 32 is forced out of the body 11 through an outlet check valve 40 and through the outlet port and conduit 18. The arrows generally show the direction of flow for the fluid during the pumping action.

The check valves 37 and 40 are small, thin pieces of flexible rubber which are trapped over an associated hole with a raised seating surface by means of a retaining ring that is held in the valve cavity over the rubber piece by friction. When a positive pressure appears on the inlet side relative to the outlet side, the rubber piece is pushed towards the retaining ring and away from the valve seat and the valve is open. When a vacuum appears on the inlet side relative to the outlet side, the rubber piece is pulled against the seating surface and therefore, the valve is closed. In conventional diaphragm pumps, debris from the diaphragm over a period of time is generally caught between the rubber piece and the seating surface which results in leakage as aforementioned.

Referring now in detail to FIG. 3, the inventive concept is illustrated wherein it can be seen that a sandwich layer is provided with the metal washer 33 supporting the fiber washer 22 and wherein both washers are attached to the underside of the connecting rod 23 by means of the screw 34. An adhesive layer 35 secures the washer arrangement to the central upper surface of the flexible diaphragm 21 which has a graphite coating 36 on its underside. Alternately, the sandwich layer of the washers 22 and 33 may be manufactured as an integral part of the connecting rod 23 and then bonded to the diaphragm 21 with an adhesive layer 35. The diaphragm is die-cut polychloroprene and it is relatively inexpensive to manufacture as compared to conventionally molded diaphragms. Also, tooling costs for a cutting die are substantially less than for a rubber compression mold as is conventional. The diaphragm is coated on its pumping chamber side with a fine graphite powder so as to reduce the diaphragm's wear at its circumference which is trapped between the top ring and the pump body. This reduction of wear reduces leaks of the outlet valve since less debris is produced.

It is to be particularly noted that there is no washer on the pumping chamber side of the diaphragm to hold the diaphragm to the connecting rod. Instead, an adhesive bonds the diaphragm's upper surface to the bottom washer. The bottom washer has a countersink to accommodate the flathead screw for connection to the end of the connecting rod. The flathead screw has a 100° angle since this is the largest angle commonly available. The larger angle reduces the require thickness of the washers and therefore their weight. Less weight improves the pump's efficiency. The fiber washer is a low cost and low weight spacer to accommodate the 100° head screw and bottom washer and is helpful in centering the diaphragm during assembly Because there is no washer on the underside of the diaphragm, in the pumping chamber side, there is nothing for the diaphragm to shear against when it is stretched due to its reciprocating motion. Therefore, no debris is created to disrupt the checkvalve's sealing action.

Referring to FIG. 4, the prior art conventional diaphragm is illustrated which takes the form of a diaphragm 40 having one or more convolutions in it to help minimize stress with each stroke. The diaphragm 40 is illustrated with a single convolution 41 and it is further noted that the diaphragm is squeezed between an upper washer 42 and a lower washer 43 which is in the pumping chamber side of the pump. Since the convolution and the washers are employed, it will produce debris that will fall into the checkvalves and cause clogging. The molded diaphragm is sandwiched between the two washers and the fluid to be pumped enters the pump through the inlet port and passes through the inlet checkvalve when the diaphragm is pulled up by the action of the motor and eccentric cam. When the diaphragm moves back downward by the action of the motor and cam, the pump fluid is forced out of the outlet checkvalve through the outlet port.

Referring to FIG. 5, the integral combination of washers 22 and 23 with connecting rod 23 is shown as a single molded element 44 which is attached with adhesive layer 35 to the central upper surface of the flexible diaphragm 21 which has a graphite coating 36 on its underside.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A fluid pump comprising:

a housing having an open cavity;

a flexible diaphragm having a continuous edge marginal region extended across said housing cavity to define one side of a pumping chamber and having said edge marginal region of said flexible diaphragm captured by said housing to define an exposed central attachment area;

actuation means secured solely to said central attachment area of said flexible diaphragm opposite to its side defining said pumping chamber for moving said flexible diaphragm back and forth for cyclically maintaining the pumping operation in said housing pumping chamber;

said actuation means includes a reciprocating connection rod having a terminating end secured to said diaphragm central area whereby reciprocating movement of said connection rod is transferred to said diaphragm;

said connection rod terminating end securement includes an attachment assemblage comprising:

a first washer having a hole and adhesively secured on one side to said exposed diaphragm central area;

a second washer disposed between said first washer and said connection rod terminating end; and a screw fastening said first and second washers together with said connection rod.

2. A fluid pump comprising:

a housing having an internal pumping chamber exposed externally via an access opening;

a flexible diaphragm extended across said housing pumping chamber closing said chamber from said access opening;

said flexible diaphragm having an undersurface facing said internal pumping chamber and an upper, outer surface facing said access opening;

motor-driven actuation mechanism mounted on said housing adjacent said access opening and operably connected to said exposed outersurface of said diaphragm for reciprocally moving said diaphragm to promote a pumping action;

said actuation mechanism includes a revolving eccentric cam and connecting rod constituting a cam follower;

an attachment means coupling said connecting rod to said exposed outer surface of said flexible diaphragm via a fabric washer and a metallic washer concentrically attached to said exposed outer surface of said flexible diaphragm;

said washers occupying the central area of said flexible diaphragm so as to define a flex portion of said diaphragm between the periphery of said washers and said housing defining said access opening; and said connecting rod is provided with an integral flanged surface bonded to said upper, outer surface of said washers.

* * * * *